United States Patent [19]

Hensley

[11] Patent Number: 4,881,597

[45] Date of Patent: Nov. 21, 1989

[54] ENVIRONMENTALLY SAFE LOCKING CAP FOR MONITORING WELL

[76] Inventor: Jerry C. Hensley, 6374 SW. 22nd Ct., Miramar, Fla. 33023

[21] Appl. No.: 194,868

[22] Filed: May 17, 1988

[51] Int. Cl.[4] ..... E21B 33/02

[52] U.S. Cl. ..... 166/92; 166/75.1; 220/315; 220/337; 220/344

[58] Field of Search ..... 166/92–94, 166/75.1, 97; 220/210, 244, 253, 315, 334, 337, 343, 344, 304; 137/363; 138/89, 96 R

[56] References Cited

U.S. PATENT DOCUMENTS

| | | | |
|---|---|---|---|
| 875,689 | 1/1908 | Bowser | 137/493.8 X |
| 1,345,214 | 6/1920 | Moore | 166/92 |
| 1,689,979 | 10/1928 | Tate et al. | 220/210 X |
| 1,791,277 | 2/1931 | Lake | 220/210 |
| 2,169,312 | 8/1939 | Wilking | 220/210 |
| 2,179,191 | 11/1939 | McWilliams | 166/92 |
| 3,394,836 | 7/1968 | Millard | 220/210 |
| 3,722,549 | 3/1973 | Wilson et al. | 166/92 X |
| 3,860,142 | 1/1975 | Jurges | 220/344 |
| 4,370,919 | 2/1983 | Wagner et al. | 220/210 X |
| 4,457,448 | 7/1984 | Beagell | 166/93 X |

*Primary Examiner*—Bruce M. Kisliuk

*Attorney, Agent, or Firm*—Harry W. Barron

[57] ABSTRACT

An environmentally safe monitoring well cap has a base and a hingely rotatable cap attached to the base. The base includes a coupling section which fits around the monitoring well casing and the coupling sections includes a ledge having an O-ring position thereagainst for contacting the top of the casing to provide a fluid seal. In addition, a flange extends outward from the bottom of the base section and is encased in grout to prevent the removal of the cover. The cap rotates about hinges from base to cover the top of the base. A ridge and O-ring are provide for the cap to seat against the base to provide a fluid tight seal. In addition, a rotating locking member is provided to permit the cap to be locked in place and to be held under tension against the upper O-rings.

10 Claims, 1 Drawing Sheet

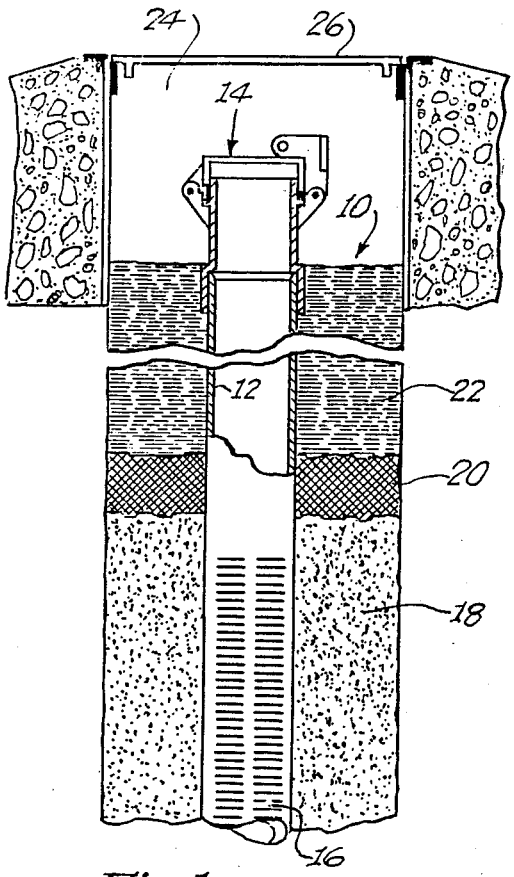
Fig. 1.
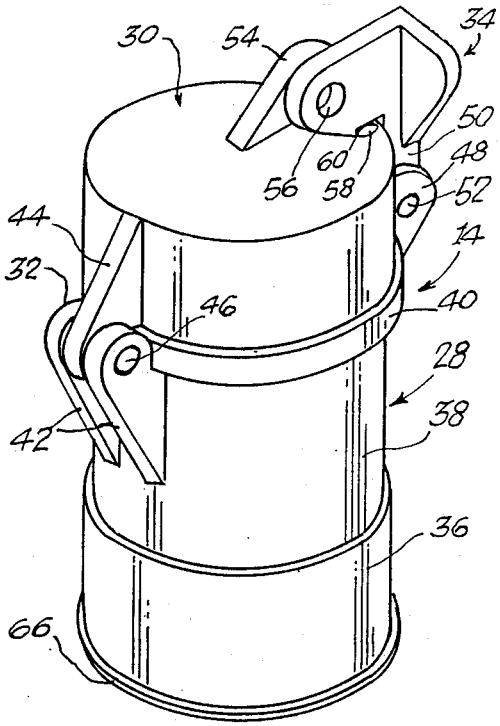
Fig. 2.
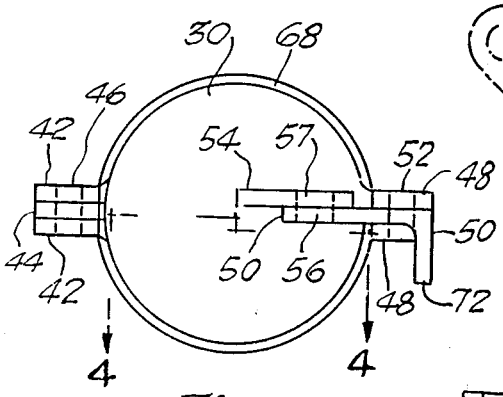
Fig. 3.
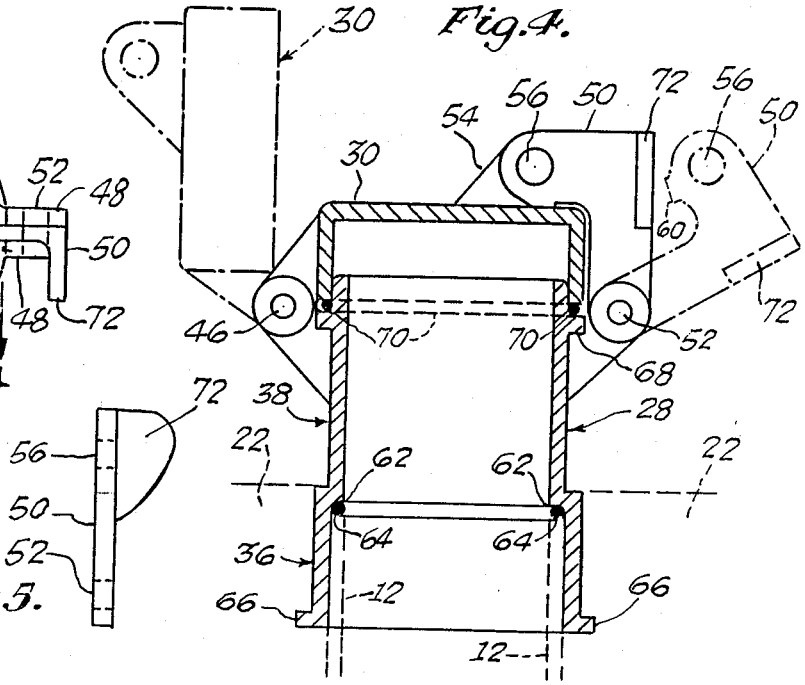
Fig. 4.
Fig. 5.

ENVIRONMENTALLY SAFE LOCKING CAP FOR MONITORING WELL

This invention relates to a cap for a environmental monitoring well and more particularly to such a cap which is both environmentally safe and capable of being locked to prevent pollutions from entering the monitoring well.

In recent years environmental concerns have dictated that monitoring wells be placed in areas where pollution could effect the environment, and particularly, the undergound fresh water supply. It has become quite common for a series of monitoring well to be placed around environmentally sensitive areas, such as where chemical or fuel are used or stored. An example, is the conventional gasoline station, which has large tanks for storing the various grades of gasoline sold. If these tanks begin leaking, the gasoline can seep through the ground and into the water table, thereby causing serious damage to the underground water supply.

In order to protect the water supply, environmental monitoring well are placed at various locations around the tanks and periodically the water is sampled for pollution. Where pollution is found, the cause of the pollution can be traced to a particular cause and that cause can be corrected. For example, the cause may be a leaky gasoline storage tank.

Typically, a monitoring well is placed in a manhole slightly below ground level. The manhole, and associated manhole cover, protect the monitoring well from vandalism and breakage. However, because the top of monitoring well is below ground, care must be taken to secure the open top with a cap which is fluid tight in order to prevent fluid from seeping into the well and polluting the water. For example, in a service station, gasoline and oil are continually spilled on the ground by the customers. During a heavy rain, the manhole may become filled with water and this water may contain pollutions picked up from the surrounding area. It is imperative that the cap use to seal the monitoring well prevent this polluted water from entering the well and polluting the water supply below ground being monitored.

Another very serious problem with monitoring wells has been found to exist when trucks delivering new gasoline mistake the monitoring well for the gasoline storage tank inlet. A driver delivering fuel who mistake the monitoring well will cause tank inlet and pumps gasoline into the monitoring well will cause a major environmental pollution of the underground water supply. In order to prevent this type of mistake, the monitoring well cap should be capable of being locked with keys only being made available to those having a reason to inspect the monitoring well. If the cap is locked, the driver of the gasoline truck would be unable to open the well without the key and thus could not pump gasoline into the monitoring well.

In the past, other have disclosed different types of caps for fill pipes or the like. For example, reference is made to U.S. Pat. Nos. 875,689, 1,989,300, 2,264,760, 3,461,905, 3,860,142 and 4,370,919. Various of these types of caps show locking mechanism or other mechanisms, but none are not satisfactory to protect a monitoring well.

In accordance with one aspect of this invention, there is provided a cap for an environmental monitoring well which includes a casing extending from an area below ground to be monitored. The cap includes a base having fixation means extending therefrom to form an environmentally safe seal with a well casing and a cap hingedly affixed to the base for permitting the cap to be rotated from a open position, thereby allowing access to the casing through the base, to closed position covering the base. In addition, there is provided a environmentally safe seal means between the cap, when in the closed positions, and the base and mating first and second means affixed to the base respectfully to permit the cap to be locked in the closed position.

One preferred embodiment of the subject invention is hereafter described, with specific reference being made to the following Figures, in which:

FIG. 1 shows a monitoring well having a cap of the subject invention affixed thereto;

FIG. 2 is a perspective view of the cap of the subject invention;

FIG. 3 is a top view of the cap of the subject invention;

FIG. 4 is a view, partially in cut-a-way, showing in more detail, the components and operation of the cap of the subject invention; and FIG. 5 is a view of the handle of the cap of the subject invention.

Referring now to FIG. 1, a monitoring well 10 is shown having a casing 12 extending below ground covered by the cap system 14 of the subject invention. The casing 12 extends into the ground to a point where the water table exists. The end of casing 12 has screen 16 which may be a series of slits, or other openings in casing 12. This area of casing 12 is surrounded by gravel packing 18. Above the gravel packing 18 is layer, approximately one foot in thickness, of a bentinite seal material 20 and above the bentinite seal material 20 layer is cement grout 22 extending upward to the top of casing 12. The distance of grout 22 may be from twenty feet for a shallow well to well over two hundred feet for deep wells.

Positioned above casing 12 and within manhole 24 is the environmentally safe cap of the subject invention. It is desirable that cap system 14 be permanently affixed to casing 12 in a sealed and liquid tight manner and further, that cap system 14 be capable of being locked to prevent unauthorized access to the monitoring well.

Referring now to FIG. 2 a prospective view of cap system 14 is shown. Cap system 14 includes a base 28, cap portion 30 and hinge 32 connecting cap portion 30 and base 28. In addition, cap system 14 includes a locking mechanism 34 which is used to secure cap portion 30 against base 28 in a sealed position as well as being capable of receiving a conventional lock. The entire monitoring well cap system 14 may be fabricated by injection molding techniques out of PVC of other plastic material. Preferably PVC is utilized because the casing 12, shown in FIG. 1, is typically PVC pipe. However, other materials, such as Teflon or stainless steel, may be also be utilized for either casing 12 or cap system 14.

Base 28 includes a coupling section 36 and an extension section 38. Coupling section 36 is designed to fit around the outside diameter of casing 12 and be secure thereto be adhesive or other known securing procedures. Extension section 38 extends above coupling section 36 in order raise cap portion 30 above the level of the top of casing 12. Above extension section 38 is sealing section 40, upon which cap portion 30 fits to seal entry to casing 12.

Hinge 32 includes a pair of lower portions 42 extending from extension section 38 and separated sufficiently to permit an upper portion 44 therebetween. Upper portion 44 extends from cap portion 30. The two lower portion 42 and the upper portion 44 are hingedly affixed together by hinge pin 46.

Locking mechanism 34 includes lower hinge portion 48 which extends from extension section 38 of base 28. While only one lower hinge portion 48 is shown in FIG. 2, it should be understood that two are provided in a manner similar to the two lower portions 42. Between he two lower hinge portions 48 is placed rotating lock member 50 pivotally held thereto by pin 52 so as to permit member 50 to rotate. Placed on cap portion 30 is cap lock member 54 which is positioned to have a hole 57 (shown in FIG. 3) therein aligned with hole 56 of rotating lock member 50. A conventional pad lock may be inserted through hole 56 and the corresponding hole 57 in member 54 to prevent the opening of cap portion 30. A nipple 58 may be provided on cap portion 30 in alignment with tip 60 of rotating lock member 50 to force cap portion 30 downward against the sealing section 40 of base 28.

Referring now to FIGS. 3, 4, and 5, the detail construction and operation of monitoring well cap system 14 is described. FIG. 3 shows a top view of cap system 14, FIG. 4 shows a cut-a-way view taken across lines 4—4 of FIG. 3, and FIG. 5 shows a front view of rotating lock member 50. As best seen in FIG. 4, coupling section 36, at the bottom of base 28, has an inside diameter selected to be substantially the same as the outside diameter of casing 12. Extension section 38 is position upward from coupling section 36 and has smaller inner diameter than coupling section 36, thereby forming an ledge 62 therebetween. Positioned against ledge 62 is a Teflon O-Ring 64 and when coupling section 36 is placed over the top of casing 12, the top casing 12 contacts O-Ring 64, thereby forming a liquid tight seal to prevent the seepage of water into the interior of casing 12 through the junction of coupling section 36 and casing 12.

At the bottom of coupling section 36, a flange 66 extends outward and is provided to maintain base 28 firmly in place after it is placed over casing 12 and the grout 22 is added up to the level of the top of casing 12. Thus, even after time, if the adhesive between the outer surface of casing 12 and the inner surface of coupling section 36 disintegrates, the seal formed by O-Ring 64 and the holding force as a result of grout around flange 66 maintains cap system 14 properly sealed in place.

Seal Section 40 includes ridge 68, above which a Teflon O-Ring 70 is positioned. The purpose of O-Ring 70 is to form a liquid tight seal between the bottom of cap portion 30 and base 28 when cap portion 30 is in the closed positioned, as shown in FIG. 4 by the solid lines. When cap portion 30 is in the closed position, rotating lock member 50 is in the up position, as shown in the solid lines in FIG. 4, and exerts a pressure downward against cap 54 to cause a firm seal contact between cap portion 30 and O-Ring 70. The forced compression between cap portion 30 and O-Ring 70 is in part caused by nipple 58 and tip 60 of rotating lock member 50.

When it is desired to open cap portion 30 to the position shown by the dash lines in FIG. 4, rotating member 50 is rotated clockwise about pin 52 and cap portion 30 is rotated counter clockwise about pin 46. At this position, access of to monitoring well 10 may be attained and the underground water, which has seeped within casing 12 through screen 16, may be sampled. Thereafter, cap portion 30 is rotated clockwise about pin 46 and rotating lock member 50 is rotated counter clockwise about pin 52 until the solid line position is reached, where cap 50 is sealingly locked over base 28. At this point, a lock may be inserted through holes 56 and 57 to prevent unauthorized access to the monitoring well 10.

In order to move rotating lock member 50 more easily, a handle 72 is provide thereon which is best shown in FIGS. 3 and 5. Space on the top of cap portion 30 is provided to permit warning signs that the cap portion 30 covers a monitoring well. Such a warning is designed to further warn off the mistaken identity of the monitoring well for a tank inlet pipe. When utilizing monitoring well cap system 14, as fabricated and described above, it is apparent that all of the necessary requirements for a monitoring well cap are provided, that is, the cap is fluid tight with respect to the well casing and is tamper proof to avoid the mistaken insertion of hazardous chemicals such as gasoline into the monitoring well. Further, because the parts can all be injection molded, the cost of cap system 14 is economical.

What is claimed is:

1. A cap for an environmental monitoring well, said well including a casing extending from an area below ground to be monitored, said casing being encased in grout, said cap comprising:

a base, including affixation means extending therefrom to form an environmentally safe seal with said well casing and further including a flange extending outwardly therefrom positioned downward from said affixation means at a position to be covered by said grout;

a cap hingedly affixed to said base at a position upward from said affixation means for permitting said cap to be rotated from an open position, allowing access to said casing through said base, to a closed position covering said base;

environmentally safe seal means between said cap, when in said closed position, and said base; and mating first and second locking means affixed to said base and cap respectively to permit said cap to be locked in said closed position;

wherein said cap is affixed to a cap end of said base; and wherein said base includes a ridge around an outer surface of said base, positioned remote from an upper edge of said base, against which said seal means is compressed by said cap when said cap is in said closed positioned, said cap being juxtaposed against said base from said seal means to said cap end when said cap is in said closed positioned.

2. The invention according to claim 1:

wherein said base has a certain inner diameter and said affixation means has an inner diameter substantially equal to the outer diameter of said casing and greater than said certain inner diameter, whereby a ledge is between said base and affixation means; and wherein second seal means is positioned against said ledge.

3. The invention according to claim 2:

wherein said flange extends outward by an amount such that when grout is placed around said casing and flange, said cap cannot be removed from said casing.

4. The invention according to claim 3 wherein one of said first ands second locking means is hingedly affixed to one of said cap or base to hold said cap against said first seal means under compression.

5. A injection molded and environmentally safe cap for an environmental monitoring well, said well including a casing extending upward from an environmentally sensitive area substantially below ground level to a covered monitoring area slightly below ground level, said cap comprising:

base means, including an opening therethrough, a lower portion of said opening being sized to fit around said casing, said opening including a ledge between said lower portion and the upper portion, said base means further including a ridge around the outer surface thereof in the upper portion of said base and a flange extending from a lower end of said lower portion:

first seal means juxtaposed with said ledge;

second seal means juxtaposed with said ridge on the side thereof directed away from said ledge;

a cap; and latch means affixed between said cap and said base to hold said cap under compression against said second seal means.

6. The invention according to claim 5 wherein said latch means includes hinge means to permit said cap to rotate from a closed position against said second seal means to an open position exposing said opening.

7. The invention according to claim 6 wherein said latch means includes means for receiving a lock.

8. The invention according to claim 7 wherein said flange extends from the lower end of said lower portion by an amount to prevent said cap from being removed from said casing when grout is places around said casing and flange.

9. The invention according to claim 8:

wherein said ridge is remote from an upper end of said base; and wherein said cap, when in said closed position, is positioned around said base and against said second seal means.

10. The invention according to claim 6:

wherein said ridge is remote from an upper end of said base; and wherein said cap, when in said closed position, is positioned around said base and against said second seal means.

* * * * *